US005878109A

United States Patent [19]

Negle et al.

[11] Patent Number: 5,878,109

[45] Date of Patent: Mar. 2, 1999

[54] X-RAY APPARATUS

[75] Inventors: Hans Negle, Nahe; Martin Wimmer, Bad Oldesloe, both of Germany

[73] Assignee: U. S. Philips Corporation, New York, N.Y.

[21] Appl. No.: 862,020

[22] Filed: May 22, 1997

[30] Foreign Application Priority Data

May 29, 1996 [DE] Germany ..... 196 21 528.5

[51] Int. Cl.[6] ..... H05G 1/34

[52] U.S. Cl. ..... 378/109; 378/201

[58] Field of Search ..... 378/109, 201, 378/203

[56] References Cited

FOREIGN PATENT DOCUMENTS

4201616A1 7/1993 Germany .

*Primary Examiner*—Craig E. Church

*Attorney, Agent, or Firm*—Jack D. Slobod; Dwight H. Renfrew

[57] ABSTRACT

An X-ray apparatus includes an X-ray source with an X-ray tube (2) arranged in a protective tube housing (1) and a filament converter which is connected to the cathode (3) of the X-ray tube (2) and accommodated in the protective tube housing (1). Because of its volume, the filament converter usually cannot be accommodated in the protective tube housing (1) of conventional X-ray apparatus unless major structural modifications are made. However, the use of attenuated high-voltage cables at the cathode side is then impossible still. The invention utilizes a filament converter in the form of a coreless filament transformer (14, 15, 16, 17) and the primary coil (14, 16) of the filament transformer is arranged so as to be coaxial with the secondary coil (15, 17) of the filament transformer. Moreover, the two coils are arranged around a carrier (5, 10), which is preferably the high-voltage connection socket (10) or the tube neck (5). This is an inexpensive and structurally simple solution which enables integration of the filament converter in the protective tube housing (1) in conventional X-ray apparatus.

15 Claims, 4 Drawing Sheets

X-RAY APPARATUS

BACKGROUND OF THE INVENTION

The invention relates to an X-ray apparatus which includes an X-ray source with an X-ray tube arranged in a protective tube housing and a filament converter which is connected to the cathode of the X-ray tube and accommodated in the protective tube housing.

An X-ray apparatus of this kind is known from DE-A 42 01 616. The filament converter thereof is constructed, for example as a type of bushing transformer which includes a ferrite core.

A filament converter constructed as a filament transformer having a ferrite core is generally comparatively voluminous so that such a filament converter cannot be built into the protective tube housing of an X-ray source with conventional X-ray tubes without modifying the construction of the X-ray source.

SUMMARY OF THE INVENTION

Therefore, it is an object of the invention to propose steps which enable integration of the filament converter in the protective tube housing in various conventional X-ray apparatus, without necessitating major modifications of the construction of the X-ray apparatus.

This object is achieved according to the invention in that the filament converter includes a coreless filament transformer, that the primary coil of the filament transformer is arranged so as to be coaxial with the secondary coil of the filament transformer, and that the coils enclose a carrier.

Because of the construction of the filament converter according to the invention, notably because of the absence of the transformer core, the filament converter can be accommodated in the protective tube housing, even in the case of conventional X-ray tubes, without necessitating major modifications of the geometry and dimensions thereof. Space is also saved by the coaxial arrangement of the coils relative to one another and their arrangement around a carrier. Because of the absence of the core, the filament converter can also be arranged in various locations within the protective tube housing and be fitted, for example in predetermined spaces in the X-ray source. Finally, costs are saved by the omission of the core and the use of simpler insulating members between the coils of the filament transformer.

In a preferred embodiment of the invention the carrier is formed by the neck of the X-ray tube, or by a high-voltage connection socket via which the X-ray tube receives a high voltage from a high-voltage generator, and the primary coil coaxially encloses the secondary coil. The tube neck as well as the high-voltage connector socket generally have a rotationally symmetrical construction and are particularly suitable to act as a carrier for the coils. Because the secondary coil, supplying the filament current for the cathode, at the same time carries the high-voltage potential of the cathode, the secondary coil preferably directly encloses the tube neck or the high-voltage connector socket, whereas for reasons of insulation the primary coil, carrying low-voltage potential, encloses the secondary coil coaxially with a clearance or separated therefrom by an insulating member. This arrangement saves a particularly large amount of space and can be used in conventional X-ray sources.

A further embodiment of the X-ray apparatus according to the invention includes two filament converters which are constructed as coreless filament transformers, the primary coils and secondary coils of the two filament transformers enclosing a common carrier.

An X-ray tube often comprises two cathode elements for adjusting a large focus and a small focus. For each of these two cathode elements there is provided a respective filament transformer whose coils enclose a common carrier, preferably the tube neck or the high-voltage connection socket.

An embodiment of the X-ray apparatus according to the invention includes means for the compensation of tube disturbances. Particularly attractive is the use of an attenuated high-voltage cable for the supply of the high voltage from a high-voltage generator to the cathode of the X-ray tube. Such attenuated high-voltage cables are known from the cited DE-A 42 01 616, but can be used in conventional X-ray apparatus only after integration of the filament converter in the X-ray source. Such an attenuated high-voltage cable, also utilized for applying the high voltage to the anode of the X-ray tube, enables strong attenuation of a traveling wave caused by a breakdown in the X-ray tube. This offers a substantially improvement of the electromagnetic compatibility in the case of X-ray disturbances and reduces the risk of damaging of the X-ray tube or the high-voltage generator.

A further embodiment of the X-ray apparatus according to the invention includes a compensation circuit for reducing stray field losses of the filament transformer. Because a transformer without a transformer core (for example, a ferrite or iron core) involves strong stray fields and substantial reactive power must be provided for its operation, substantially higher voltages and/or currents are required for operation. These losses, however, can be substantially reduced by means of a suitable compensation circuit.

BRIEF DESCRIPTION OF THE DRAWING

The invention will be described in detail hereinafter with reference to the drawing. Therein.

DETAILED DESCRIPTION OF THE PREFERRED EMBODIMENTS

Figure 1:
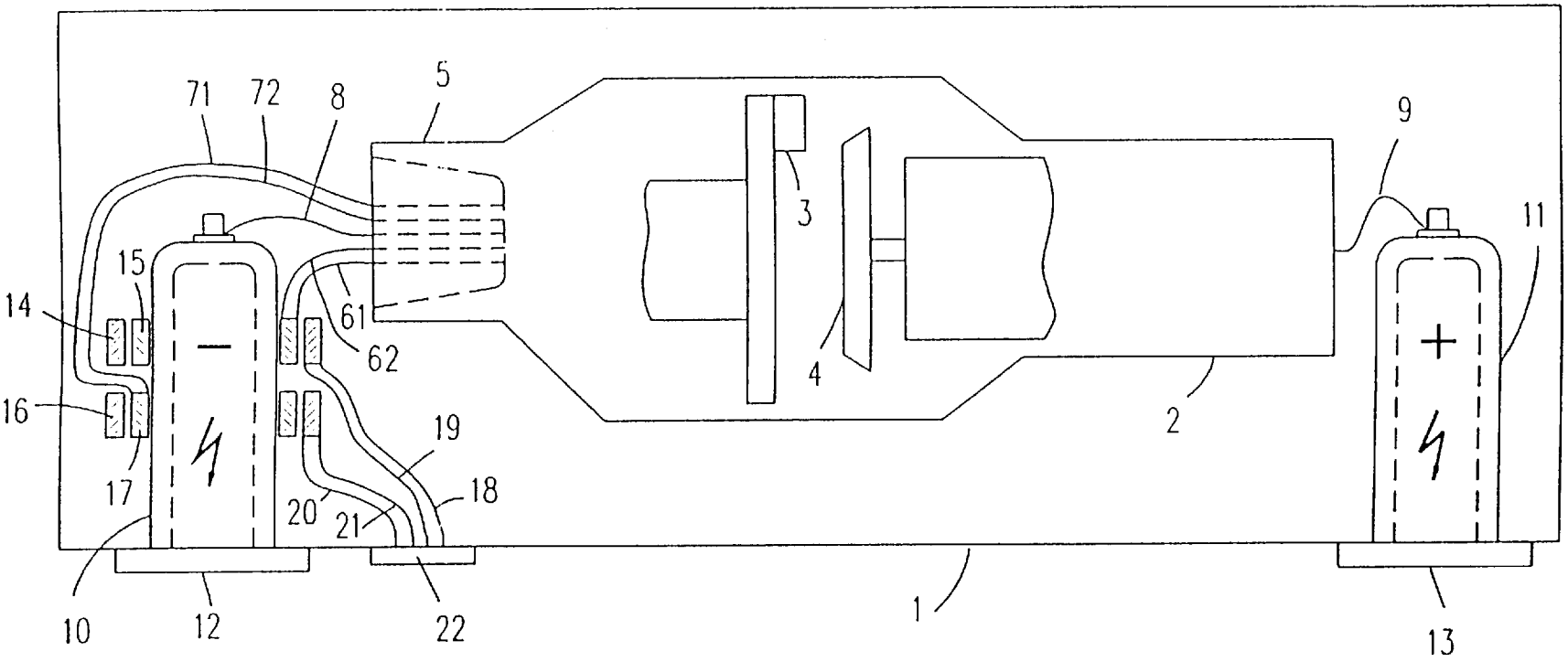
FIG. 1 shows a first embodiment of an X-ray apparatus according to the invention.

The X-ray apparatus shown in FIG. 1 includes an X-ray source with an X-ray tube 2 which is accommodated in a protective tube housing 1. A cathode block 3 and a rotary anode 4 of conventional construction are provided in the X-ray tube 2. In order to obtain two different focus sizes, the cathode block comprises two cathode elements (not shown) which are powered via two separate filament converters in the present example. The filament currents are applied to the cathode elements via leads 61, 62 from the first filament converter and leads 71, 72 from the second filament converter. The leads 61, 62, 71, 72 are fed into the X-ray tube 2 via the tube neck 5. At the neck there is also provided a high-voltage supply lead 8 via which the cathode elements receive a negative high voltage of −75 kV with respect to ground. At the end of the X-ray tube 2 which is remote from the tube neck 5 there is provided a further high-voltage supply lead 9 via which the anode 4 receives a positive high voltage of +75 kV with respect to ground. The protective tube housing 1 is provided with two high-voltage connection sockets 10 and 11 for the supply of the high voltage to the X-ray tube 2. The high-voltage cables which apply the high voltages of + and −75 kV, generated by a high-voltage generator (not shown), to the X-ray source are connected to the high-voltage connection sockets 10 and 11 via the high-voltage inputs 12, 13.

A separate filament converter is provided for each of the two cathode elements. Both filament converters are constructed as similar, coreless filament transformers, i.e. transformers without a ferrite or iron core, and each transformer consists of a primary coil 14 and 16 and a secondary coil 15 and 17, respectively. The primary coil 14 of the first filament transformer is arranged coaxially around the secondary coil 15 of the first filament transformer. The secondary coil 15 is arranged around the high-voltage connection socket 10 which acts as a carrier. Similarly, the primary coil 16 of the second filament transformer is arranged coaxially around its secondary coil 17, and the latter is arranged around the high-voltage connection socket 10. The primary coil 14 is fed via supply leads 18, 19, and the primary coil 16 via supply leads 20, 21. A filament current terminal 22 is provided on the protective tube housing 1 for feeding the primary coils 14 and 16. The filament current of the secondary coil 15 of the first filament transformer is applied, via the leads 61 and 62, to the first cathode element for obtaining, for example a small focus. Via the leads 71 and 72, the second cathode element is supplied with a filament current from the secondary coil 17 of the second filament transformer in order to obtain, for example a large focus.

The filament converter in the known X-ray apparatus has a ferrite core. Because of their volume, such filament converters with a transformer cannot be accommodated inside the protective tube housing of an X-ray apparatus of this kind without modifications of the geometry of the X-ray tube and/or the protective tube housing. The construction of the filament converter without ferrite or iron core according to the invention, however, makes such building in possible. The invention utilizes the rotationally symmetrical construction of the high-voltage connection socket 10 around which the coils 14 to 17 of the filament converter can be coaxially arranged in a simple and space-saving manner, for example by slipping on.

A further advantage of the use of filament converters without transformer core consists in that in such filament converters all core-related losses of a non-linear nature are avoided. The accuracy and reproducibility of the filament converter are thus substantially enhanced. Moreover, this embodiment is less expensive and the heat loss is also less.

Figure 2:
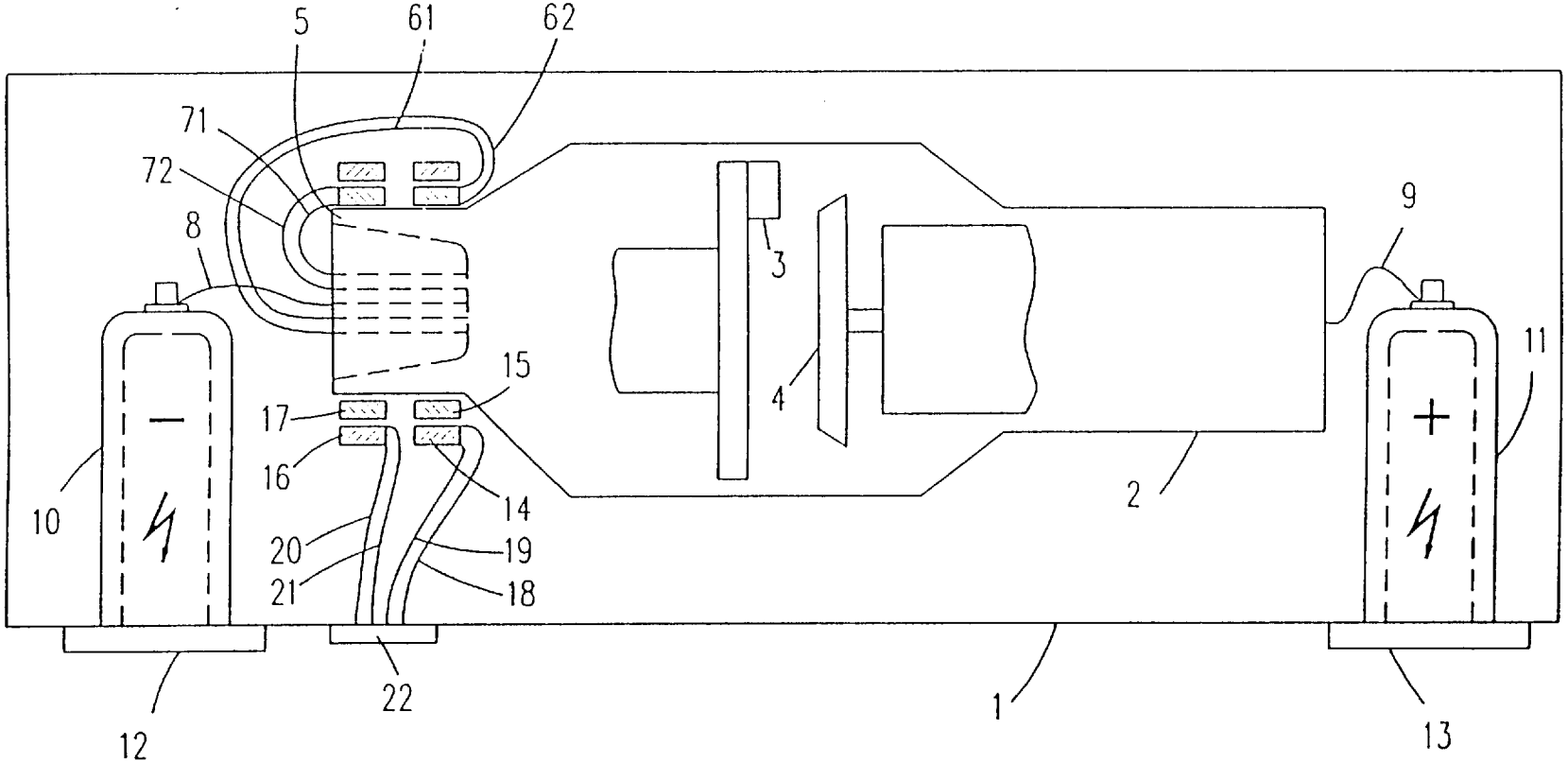
FIG. 2 shows a second embodiment of an X-ray apparatus according to the invention.

FIG. 2 shows a further embodiment. Therein, the primary coils 14, 16 and the secondary coils 15, 17 are arranged around the tube neck 5 of the X-ray tube 2 which in this case serves as a carrier. This embodiment also does not necessitate a modification of the geometry of the X-ray tube 2 or the protective tube housing 1 to enable mounting of the filament converter in the protective tube housing 1 in the manner shown.

Figure 3:
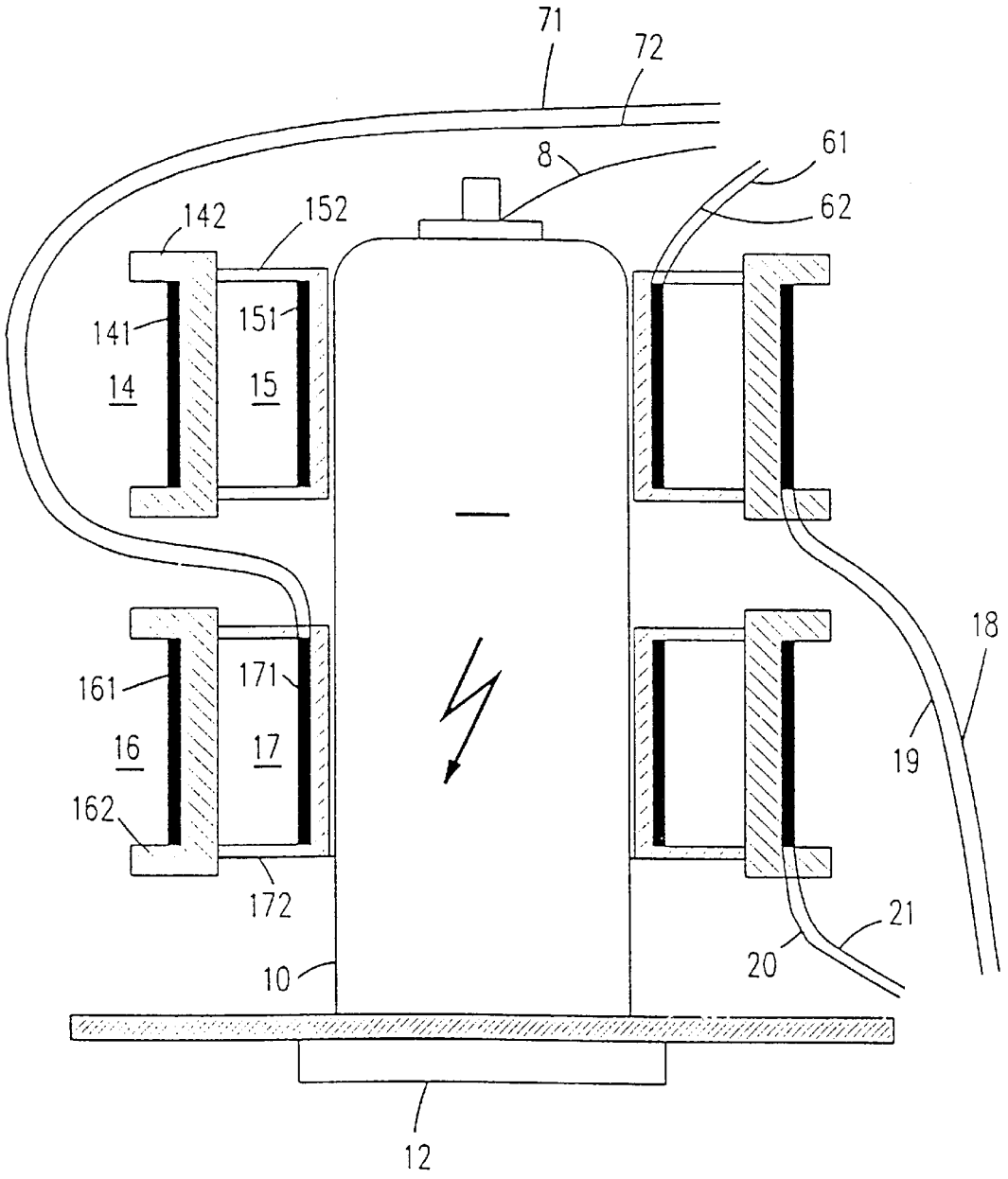
FIG. 3 shows, at an increased scale, the filament converter in an X-ray apparatus as shown in FIG. 1.

FIG. 3 shows the high-voltage connection socket 10 with the filament converters arranged in conformity with FIG. 1 at a larger scale. The primary coils 14, 16 consist of primary windings 141 and 161, respectively, which are wound onto a primary coil former 142 and 162, respectively. The secondary coils 15, 17 consist of secondary windings 151 and 171, respectively, which are wound onto secondary coil formers 152 and 172, respectively. The secondary coil formers 152, 172 are constructed so that an air gap of at least a few millimeters, for example 6 mm, exists between the secondary windings 151, 171 of the secondary coils 15, 17 and the primary windings 141, 161 of the primary coils 14, 16. This is necessary for reasons of insulation, because the secondary coils 15, 17 carry high-voltage potential (−75 kV) which is applied to the cathode via the lead 8. Each time one of the leads 61, 62 or 71, 72 from the secondary coils 15 and 17 to the cathode elements is connected to the lead 8 at the cathode side.

Further insulation and mounting members, which could also be present, have been omitted for the sake of clarity of FIG. 3.

In known X-ray apparatus the filament converter is usually mounted in a high-voltage generator outside the protective tube housing, together with a high-voltage transformer which generates the high voltage for the X-ray tube. The filament current is then applied to the X-ray source, together with the high voltage for the cathode, via a common cable. The invention enables the use of attenuated high-voltage cables, disclosed in DE-A 42 01 616, for a wide variety of X-ray sources since the filament converter is now constructed so that it can be accommodated in X-ray sources of a variety of sizes and constructions, because only the high voltage for the cathode must be applied to the X-ray source from the high-voltage generator in the case of a filament converter integrated in the X-ray source. Attenuated high-voltage cables then have the additional advantage that traveling waves from the X-ray tube to the high-voltage generator, which could be caused by a tube disturbance, are strongly attenuated so that the service life of the tube is increased. Moreover, self-curing of the anode can thus also be achieved in the case of deconditioning.

Because the tube current of an X-ray source is controlled via the primary current of the filament transformer and the secondary current of the filament transformer is adjusted via the transformation ratio of the filament transformer, severe requirements are imposed as regards linearity and constancy in time of the transformation ratio. A compensation circuit is provided in order to satisfy these severe requirements and to adjust a current transformation ratio which is independent of the load impedance of the filament transformer. The cathode element as well as the leads (resistive and capacitive) contribute to the load impedance of the filament transformer. Moreover, the compensation circuit also substantially compensates operating frequency variations and losses caused by stray field coupling in nearby metal parts and further stray field losses of the filament transformer.

Figure 4:
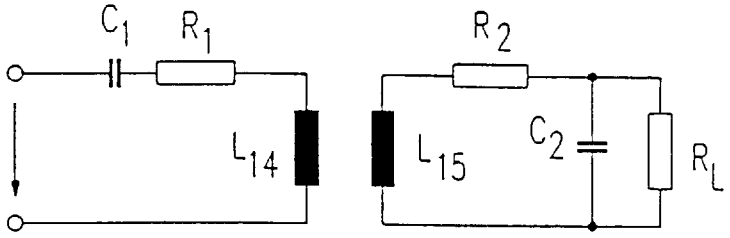
FIG. 4 shows a compensation circuit used in an X-ray apparatus according to the invention.

FIG. 4 shows such a compensation circuit for the filament transformer. The compensation circuit has series compensation at the primary side and parallel compensation at the secondary side. At the primary side (=generator side) a capacitance $C_1$ and a resistance $R_1$ are connected in series with the primary winding $L_{14}$ which corresponds to the primary coil 14 in FIG. 3. The capacitance $C_1$ represents the capacitance of the resonant compensation circuit and the resistance $R_1$ represents essentially the winding resistance of the primary coil $L_{14}$. At the secondary side a resistance $R_2$ as well as a parallel connection of a capacitance $C_2$ and the load resistance $R_L$ are connected in series with the secondary winding $L_{15}$ which corresponds to the secondary circuit 15 in FIG. 3. The resistance $R_2$ represents essentially the winding resistances of the secondary coil $L_{15}$ and the capacitance $C_2$ represents essentially the resonance capacitance of the compensation circuit, increased by the winding capacitance and a capacitance existing between the leads from the secondary coil $L_{15}$ to the cathode element.

Compensation is necessary because a substantial reactive power is to be produced for operation of a transformer with strong stray fields. In comparison with a transformer with suitable coupling, substantially larger voltages and currents are required for operating a transformer with stray fields. In order to avoid that the generator has to be loaded by these currents and voltages, it makes sense to use resonance capacitors (=compensation capacitors). The compensation circuit shown in FIG. 4 constitutes a particularly attractive solution, because the series compensation at the primary side reduces the current load, and hence also the cost of a compensation capacitor possibly required for adjusting a given capacitance value. The resistances $R_1$, $R_2$ and the capacitances $C_1$, $C_2$ should be chosen so that the current transformation ratio is substantially independent of the load resistance $R_L$ and that a minimum reactive power is required. To this end, the transformer is suitably proportioned according to known methods and the capacitances are suitably chosen.

Figure 5:
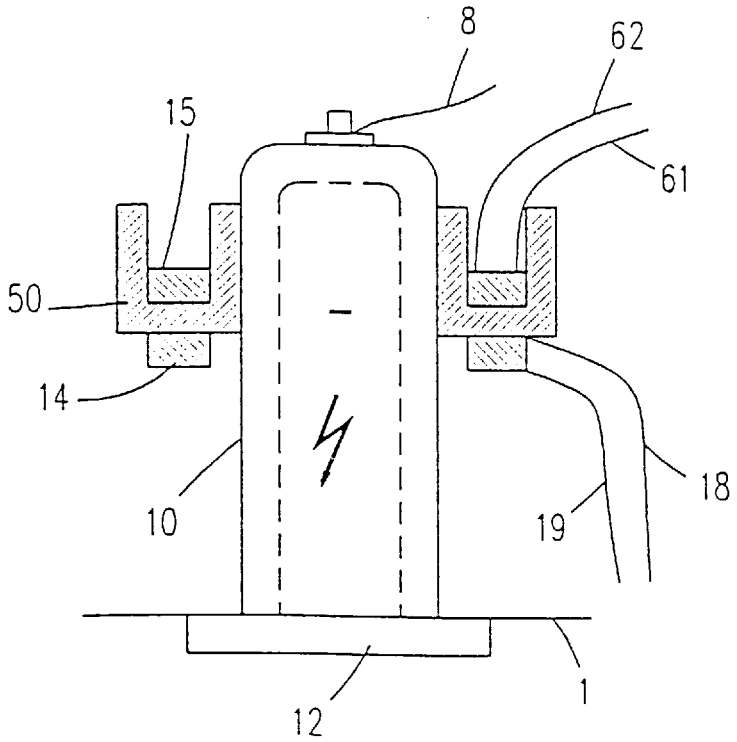
FIG. 5 shows a further embodiment of a filament converter according to the invention.

FIG. 5 shows a further, alternative embodiment of a filament converter according to the invention. The filament converter now includes only one primary coil 14 and one secondary coil 15 which have approximately the same diameter and are arranged around the high-voltage connection socket 10 in oppositely situated locations. The secondary winding of the secondary coil 15, carrying high-voltage potential, is surrounded by an insulating member 50 on three sides; this member serves mainly for insulating the primary coil 14 from the secondary coil 15, but also as a coil former for the secondary coil 15.

We claim:

1. An X-ray apparatus comprising an X-ray source with an X-ray tube arranged in a protective tube housing and a filament converter which is connected to a cathode of the X-ray tube and accommodated in the protective tube housing, wherein the filament converter includes a first coreless filament transformer comprising a primary coil which is arranged so as to be coaxial with a secondary coil, the primary and secondary coils enclosing a carrier.

2. An X-ray apparatus as claimed in claim 1, wherein the carrier is formed by a neck of the X-ray tube, or by a high-voltage connection socket via which the X-ray tube receives a high voltage from a high-voltage generator, and the primary coil coaxially encloses the secondary coil.

3. An X-ray apparatus as claimed in claim 1, further comprising a second coreless filament converter which is connected to the cathode of the X-ray tube and accommodated in the protective housing, said second filament converter comprising a further primary coil which is arranged so as to be coaxial with a further secondary coil, the further primary and secondary coils also enclosing said carrier.

4. An X-ray apparatus as claimed in claim 1, wherein the X-ray apparatus further comprises means for the compensation of tube disturbances.

5. An X-ray apparatus as claimed in claim 1, wherein the X-ray apparatus further comprises a compensation circuit for reducing stray field losses of the first filament transformer.

6. An X-ray apparatus as claimed in claim 2, further comprising a second coreless filament converter which is connected to the cathode of the x-ray tube and accommodated in the protective housing, said second filament converter comprising a further primary coil which is arranged so as to be coaxial with a further secondary coil, the further primary and secondary coils also enclosing said carrier.

7. An X-ray apparatus as claimed in claim 2, wherein the X-ray apparatus further comprising means for the compensation of tube disturbances.

8. An X-ray apparatus as claimed in claim 3, wherein the X-ray apparatus further comprising means for the compensation of tube disturbances.

9. An X-ray apparatus as claimed in claim 6, wherein the X-ray apparatus further comprising means for the compensation of tube disturbances.

10. An X-ray apparatus as claimed in claim 2, wherein the X-ray apparatus further comprises a compensation circuit for reducing stray field losses of the first filament transformer.

11. An X-ray apparatus as claimed in claim 3, wherein the X-ray apparatus further comprises a compensation circuit for reducing stray field losses of the first and second filament transformers.

12. An X-ray apparatus as claimed in claim 6, wherein the X-ray apparatus further comprises a compensation circuit for reducing stray field losses of the first and second filament transformers.

13. An X-ray apparatus as claimed in claim 7, wherein the X-ray apparatus further comprises a compensation circuit for reducing stray field losses of the first filament transformer.

14. An X-ray apparatus as claimed in claim 8, wherein the X-ray apparatus further comprises a compensation circuit for reducing stray field losses of the first and second filament transformers.

15. An X-ray apparatus as claimed in claim 9, wherein the X-ray apparatus further comprises a compensation circuit for reducing stray field losses of the first filament transformer.

* * * * *